United States Patent [19]

Lefferts

[11] Patent Number: 4,564,992

[45] Date of Patent: Jan. 21, 1986

[54] METHOD FOR PRODUCING HELIX STRUCTURES FOR USE IN FORMING HELIX BELTS

[75] Inventor: Johannes Lefferts, LM-Enschede, Netherlands

[73] Assignee: Siteg Siebtechnik GmbH, Fed. Rep. of Germany

[21] Appl. No.: 513,279

[22] Filed: Jul. 13, 1983

[30] Foreign Application Priority Data

Jul. 27, 1982 [DE] Fed. Rep. of Germany ..... 3228033

[51] Int. Cl.[4] ..... B23P 11/00

[52] U.S. Cl. ..... 29/429; 29/240; 29/429; 29/456; 29/721; 57/13; 57/18; 242/7.03

[58] Field of Search ..... 29/240, 240.5, 429, 29/434, 456, 721; 57/3, 13, 17, 18; 140/71.5, 92.3, 93.4; 242/7.03, 7.14; 264/230

[56] References Cited

U.S. PATENT DOCUMENTS

| | | | |
|---|---|---|---|
| 386,306 | 7/1888 | Emerson et al. | 140/92.3 X |
| 398,431 | 2/1889 | Midgley | 140/92.3 X |
| 1,587,856 | 6/1926 | Reed | 57/3 X |
| 2,424,518 | 7/1947 | Stuart | 140/71.5 |
| 2,541,729 | 2/1951 | Wahl | 29/456 X |
| 3,029,586 | 4/1962 | Walsh et al. | 57/3 |
| 4,149,104 | 4/1979 | Yoshimori | 140/71.5 X |

FOREIGN PATENT DOCUMENTS

| | | | |
|---|---|---|---|
| 571272 | 1/1962 | Belgium | 29/429 |
| 3017378 | 11/1981 | Fed. Rep. of Germany | 29/456 |

*Primary Examiner*—Howard N. Goldberg
*Assistant Examiner*—Ronald S. Wallace
*Attorney, Agent, or Firm*—John J. Torrente

[57] ABSTRACT

A helix of great length wherein the structure is filled with a filler and wherein the structure is produced by a practice in which the helix structure and filler material are caused to rotate about each other upstream of the point of convergence, while the helix retains its orientation, and the speed of advance of the helix and the speed at which the filler material and helix are rotated are so adjusted that the helix is advanced by one winding during each rotation.

6 Claims, 25 Drawing Figures

FIG. 2
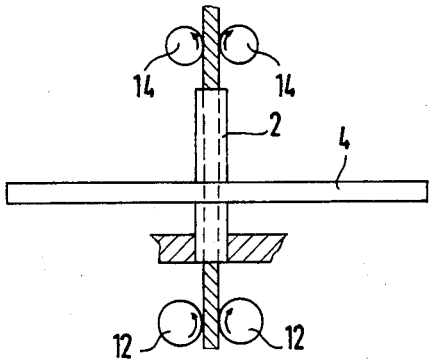
FIG. 3
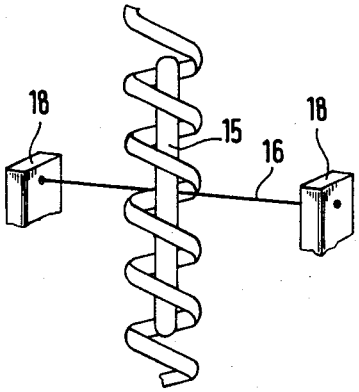
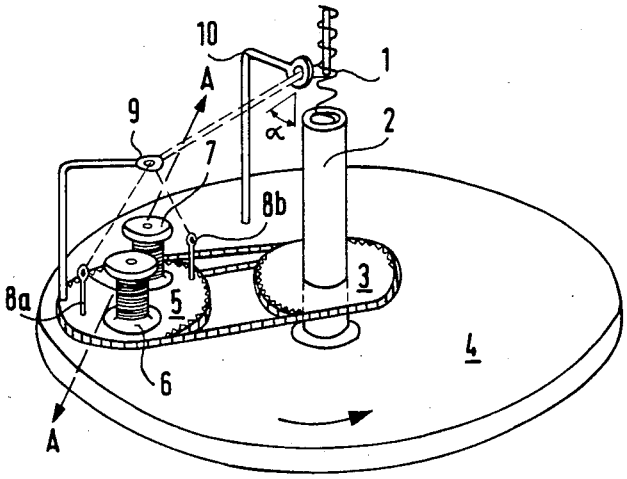
FIG. 1

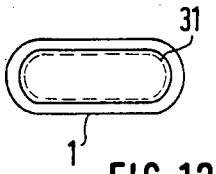
FIG. 12
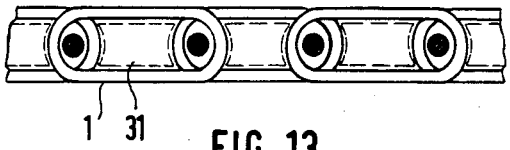
FIG. 13
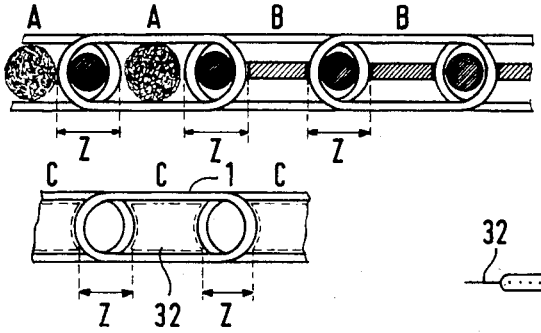
FIG. 14
FIG. 15
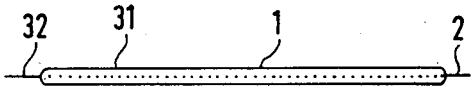
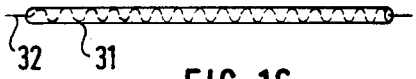
FIG. 16
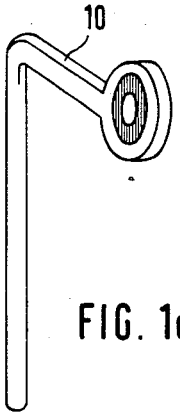
FIG. 1a
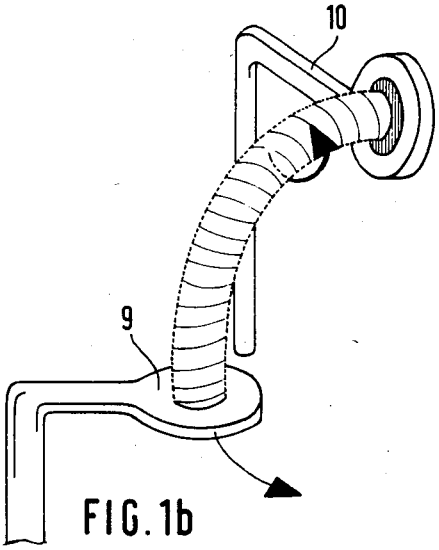
FIG. 1b

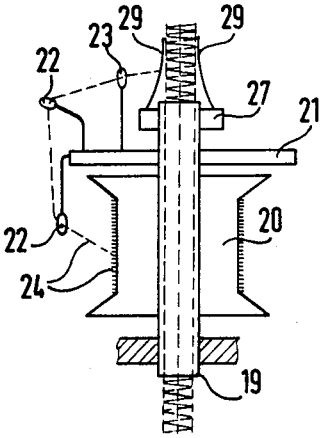
FIG. 8
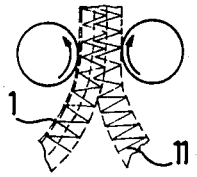
FIG. 7
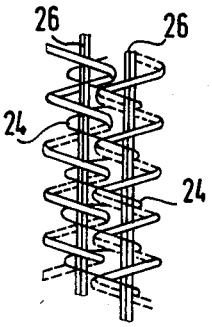
FIG. 10
FIG. 9
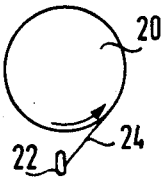
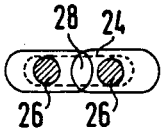
FIG. 10a
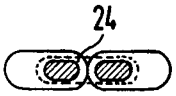
FIG. 10b
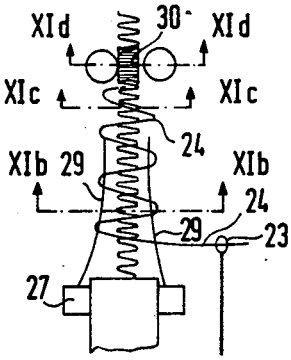
FIG. 11a
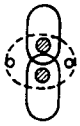
FIG. 11b
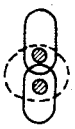
FIG. 11c
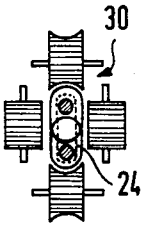
FIG. 11d

METHOD FOR PRODUCING HELIX STRUCTURES FOR USE IN FORMING HELIX BELTS

BACKGROUND OF THE INVENTION

This invention relates to a helix structure of great length for use in forming helix belts. It also relates to a method and an apparatus for producing such helix structures, and to helix belts formed from such structures.

German patent application (OS) 3,039,873 discloses a procedure for introducing filler material into helix structures which are to be made into a helix belt. In this procedure during formation, the helix structures are wound about the filler material. This mode of operation is disadvantageous, however, since it causes the filler material to become crimped. A crimped filler may give rise to difficulties. Thus, for example, it creates a risk that the filler will be blown out from between the helix windings when the helix belt is cleaned by a high pressure air jet.

Winding of the helix structure about the filler also limits the volume and hardness of the filler. In particular, excessive hardness of the filler causes deformation of the helix when wound on a mandrel. This can result in the helix becoming non-uniform and, therefore, useless.

It is also possible to push or draw the filler material into a formed helix belt. However, this technique is very cumbersome. Moreover, where a belt is very wide, its premeability cannot be sufficiently reduced, particularly in the case of an excessively strong filler material, since there arises a high friction between the latter and the inner helix surface.

It is therefore an object of the present invention to provide a helix structure of great length from which helix belts of uniform permeability can be produced.

It is a further object of the present invention to provide a method and apparatus for producing the aforementioned helix structures.

It is yet a further object of the invention to provide helix belts formed from such helix structures.

SUMMARY OF THE INVENTION

In accordance with the principles of the present invention, the above and other objectives are realized in a helix structure of great length wherein the structure is filled with a filler material.

In further accordance with the principles of the invention, the helix structure of the invention is produced by advancing the helix in a longitudinal direction and by introducing the filler material into the windings of the helix structure at a point of convergence of the windings and the filler. In particular, the helix structure and filler material are caused to rotate about each other upstream of the point of convergence, while the helix retains its orientation. The speed of advance of the helix and the speed at which the filler material and helix are rotated are then so adjusted that the helix is advanced by one winding during each rotation.

In a further aspect of the invention, apparatus for carrying out the aforesaid method is disclosed wherein a disk having two openings through which the filler and helix structure are passed is rotated by a drive means and means is provided for advancing the helix structure by one winding during each rotation of the disk.

Apparatus is also disclosed for forming a composite form of the helix structure of the invention by wrapping two intermeshed helices with yarn. Finally, a composite helix belt is disclosed wherein the belt comprises a multiplicity of intermeshed filled helix structures connected by pintle wires.

BRIEF DESCRIPTION OF THE DRAWINGS

The above and other features and aspects of the present invention will become more apparent upon reading the following detailed description in conjunction with the accompanying drawings, in which:

FIG. 1 is a composite view of an apparatus for making helix structures in accordance with the invention;

FIG. 1*a* shows a yarn guide having a rotatable eye utilized in the apparatus of FIG. 1;

FIG. 1*b* shows a helical tube connecting the eyes of two yarn guides;

FIG. 2 illustrates a means for feeding helix structures to the apparatus of FIG. 1;

FIG. 3 to 6 illustrate alternative means for advancing the helix structures;

FIG. 7 shows the filler material being carried along by means of an auxiliary helix structure;

FIGS. 8 and 9 show apparatus for wrapping two meshed, filled helix structures;

FIG. 10 shows two meshed helix structures wrapped with a wrapping yarn;

FIGS. 10*a* and 10*b* show the meshed helix structures in section;

FIGS. 11*a*, 11*b*, 11*c* and 11*d* show apparatus for advancing two meshed helix structures;

FIG. 12 illustrates a section through a helix structure filled with a braided or woven tube;

FIG. 13 illustrates the deformation of the filler tube in an assembled helix belt;

FIG. 14 shows a comparison between a helix belt filled with a yarn or a flat film tape, and a helix belt filled with a tube;

FIGS. 15 and 16 show tubes having straight and undular cores, respectively, for use as filler material.

DETAILED DESCRIPTION

Figure 4:
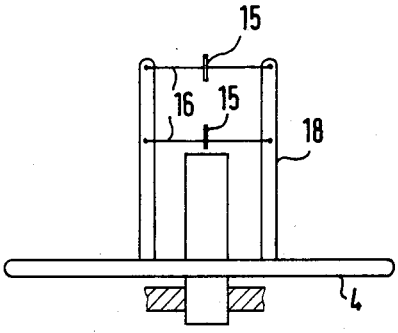

FIG. 1 shows apparatus for forming a long helix structure in accordance with the principles of the present invention. As shown, the helix structure 1 travels through a stationary tube 2 about which a disk 4 is rotating. A supply of filler material is arranged on and is rotatable relative to the disk 4. The supply is so arranged that on each rotation of the disk 4 the supply undergoes one rotation in a sense opposite to the sense of rotation of the disk 4, whereby on the whole the supply does not change its orientation. This can be achieved in a simple way.

More particularly, bobbins 6, 7 carrying the filler material are rotatably mounted on a gear 5 which, in turn, is rotatably mounted on the disk 4 at distance from the center thereof. The gear 5 is connected by a driving chain, a toothed belt or the like to a further gear 3, the latter being fixedly mounted to the tube 2.

By selecting the number of teeth of the gears 3 and 5 to be equal, the gear 5 rotates with the disk 4 about the gear 3 while it retains its orientation. Hence, the bobbins 6 and 7 always maintain the same mutual orientation, i.e., the connecting line A—A through the two bobbin centers does not change its orientation during the rotation of the disk 4. The filler material which, in the embodiment illustrated in FIG. 1, comprises two filler yarns 26, is thus introduced into the helix without any torsion. As a result, the two filler yarns lie parallel and without crossover and torsion in the helix interior.

Yarn guides 8*a*, 8*b* and 9 are fixedly connected to the gear 5 while a further yarn guide 10 is mounted to the disk 4. The filler material wound on the bobbins 6 and 7 is guided first by the yarn guides 8*a* and 8*b*, respectively, and 9 and thereafter by the yarn guide 10. The guide 10 is fixedly mounted to the disk 4 and its guiding eye is located near the center of the disk 4 and directly above the upper end of the stationary tube 2.

In accordance with the invention, the speed of rotation of the disk 4 and the speed at which the helix 1 is advanced upwardly through the stationary tube 2 are so adapted to each other that the disk 4 undergoes exactly one rotation during the time in which the helix 1 is advanced by the space of one winding. In this regard, if the helix 1 is a right-hand helix, the disk 4 turns clockwise, while in case of a left-hand helix, as shown in FIG. 1, the disk 4 turns counter-clockwise. Owing to this arrangement, the filler material is virtually turned into the helix 1. The disk 4 may rotate at a speed of 1000 to 1400 rpm, a speed at which about 150 m of helix per hour are filled.

Depending on the nature of the filler material there is the risk that torsion may be imparted to the filler material when passing through the yarn guide 10. This can be prevented by making the eye of the yarn guide 10 rotatable. FIG. 1*a* shows a yarn guide modified in this manner wherein the eye of the yarn guide is supported by way of a ball bearing whose outer race is fixedly connected to the yarn guide rod. In the embodiment of FIG. 1*a* the eye of the yarn guides rotates freely.

It is also possible to connect the inner race of the ball bearing of the guide of FIG. 1*a* to the eye of the fixed yarn guide 9 by way of a tube, e.g., a steel wire helix, as shown in FIG. 1*b*. This ensures that the rotation of the yarn guide 9 relative to the disk 4 is positively transferred to the freely rotatable eye of the yarn guide 10. Furthermore, the filler material now travels through the interior of the steel helix and is protected against torsion. When flat or tubular filler material is employed, the opening of the ball bearing, i.e., the eye of the yarn guide 10, may be narrowed to form a slot in order to prevent the filler material from twisting relative to said eye.

In lieu of the two bobbins 6, 7 shown in FIG. 1, a plurality of bobbins or only one bobbin may be used, depending on the number of individual filaments desired to form the filler material. In each case, however, an untwisted and torsion-free filling is obtained. This freedom from torsion and twist is ncessary to uniformly fill the helix interior along the entire length thereof, and to provide a sufficiently soft filling to allow meshing of a plurality of similar helix structures. If the filler material is to have a predetermined regular twist, e.g. one twist per meter, this may be realized by using gears 3 and 5 of slightly different numbers of teeth.

There are a variety of assemblies by which the helix structure 1 can be advanced through the tube 2. FIG. 2 shows one such arrangement in which feed rolls 12 are arranged below the disk 4 to guide the helix 1 into the lower end of the tube 2. At a distance from the upper end of the tube 2, draw-off rolls 14 are provided to guide the helix from the tube. The rolls 14 rotate at somewhat higher speed than the feed rolls 12, whereby the length of helix between the two pairs of rolls is extended somewhat. This reduces the number of helix windings passing between the draw-off rolls 14 per unit of time until a state of equilibrium is established. When this point is reached, the number of helix windings passing between the feed rolls 12 per unit of time is equal to that passing between the draw-off rolls 14 per unit of time. As a result, the number of helix windings between the feed rolls 12 and the draw-off rolls 14 remains constant as does the space between the individual helix windings. By varying the speed of the feed rolls 12 and the draw-off rolls 14 the rate of advance of the helix 1 and the spacing of the windings of the helix portion between the rolls can be controlled.

Another assembly for advancing the helix structure 1 is shown in FIG. 3. In this case, a pin 15 extends along an interval of a plurality of helix windings of the helix 1 and has a diameter such that it can freely rotate in the helix interior. At right angles to the longitudinal axis of the pin 15, a fastening wire 16, e.g. a monofilament, extends through the pin. The fastening wire 16 is held under tension between two supports 18 which co-rotate with the disk 4 and which can be mounted directly on the disk 4. Rotation of the fastening wire causes the helix 1 to advance. In this situation, the rate of advance of the helix 1 is controlled directly by the speed of rotation of the disk 4 and the desired adaption between the advancing motion of the helix 1 and the circular motion of the filler material is attained automatically.

FIG. 4 shows a modification of the embodiment of FIG. 3, wherein two pins 15 are arranged in spaced relation one above the other. In this case, the filler material is supplied in the space between the two pins 15.

A combination of the assemblies shown in FIG. 2 and in FIGS. 3 and 4 can also be employed to advance the helix 1. In practice, the embodiment shown in FIG. 5 has proved to be highly suitable. In this embodiment, a fastening wire 16 held lightly above the upper end of the stationary tube 2 is used in combination with draw-off rolls 14 which receive the helix 1 at some distance above the pin 15. The filler material is supplied between the pin 15 and the draw-off rolls 14.

Figure 6:
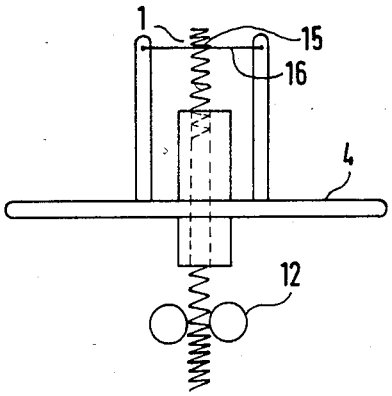

In FIG. 6, the feed rolls 12 are arranged below the disk 4 and are combined with a pin 15 arranged at a somewhat greater distance above the upper end of the stationary tube 2. The filler material, in this embodiment, is supplied between the upper end of the tube 2 and the pin 15.

Figure 17:
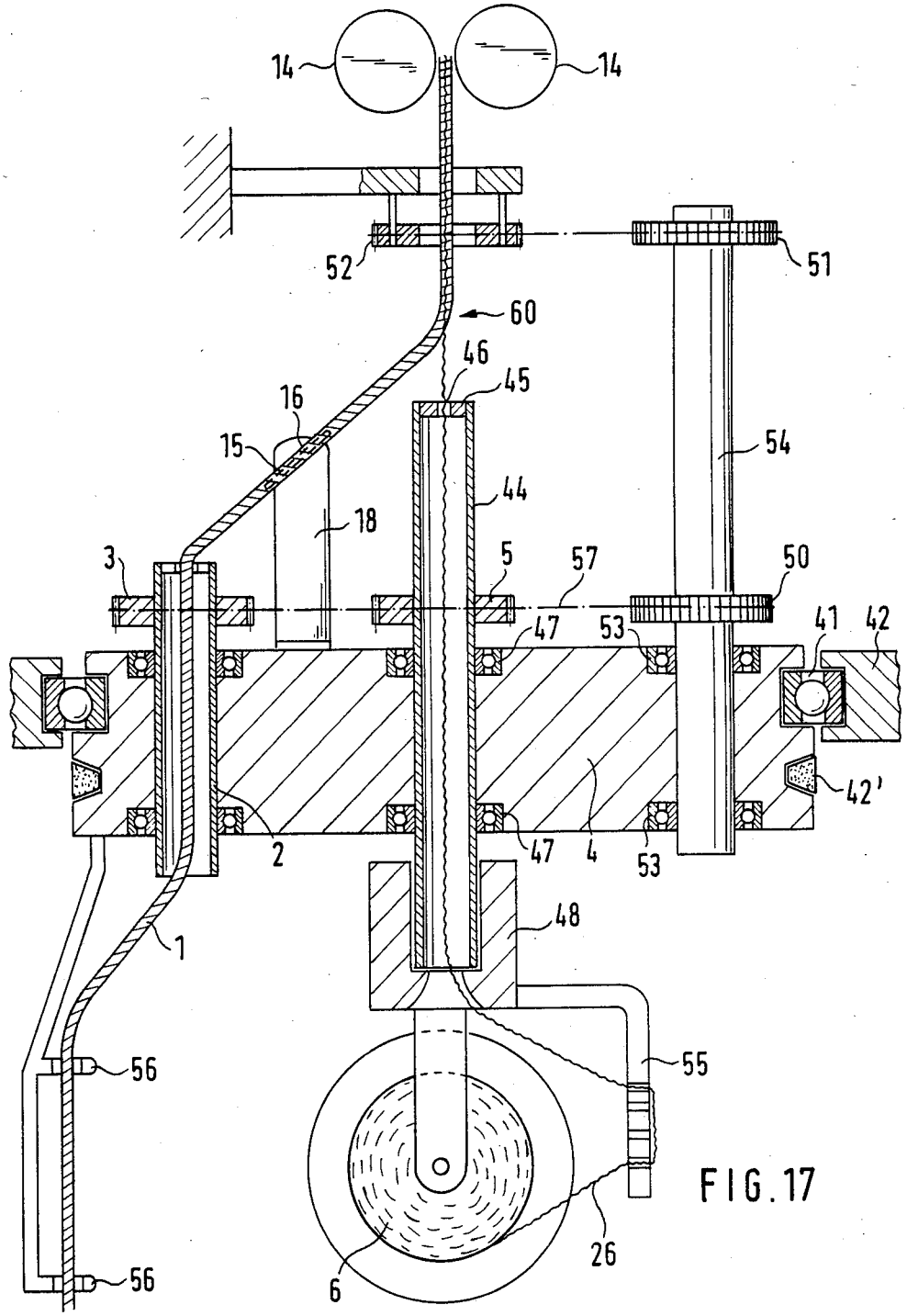
FIGS. 17 and 18 show a further embodiment of an apparatus for introducing filler material into a helix structure.
Figure 18:
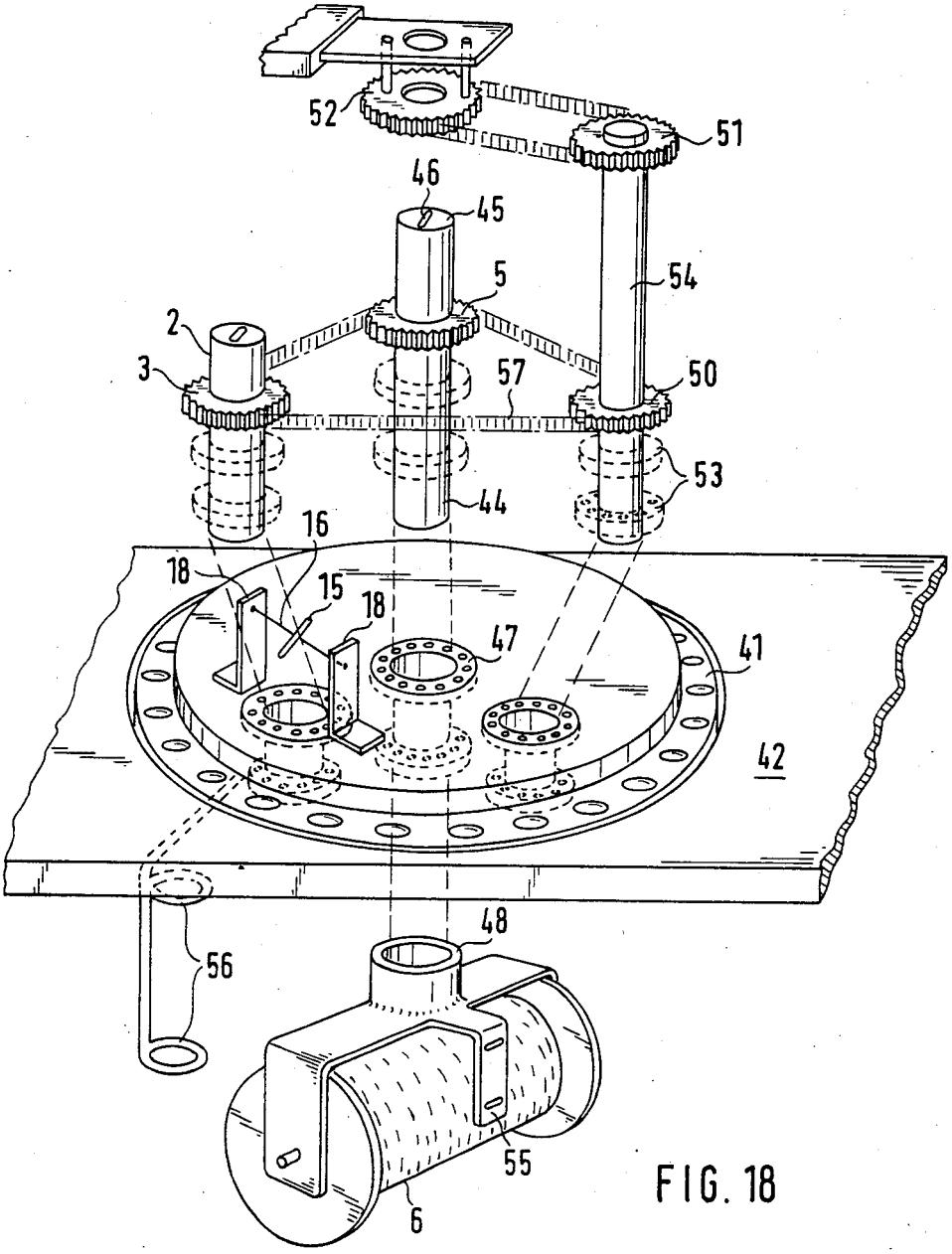

FIGS. 17 and 18 show a second embodiment of an apparatus for introducing filler material into the helix 1 in accordance with the principles of the invention. The disk 4 in this embodiment is supported for rotation in a matching circular opening in a frame 42 by way of a ball bearing 41. As shown and as will be assumed in the ensuring discussion, the axis of rotation of the disk 4 is aligned vertically. However, the principles of the invention are applicable for any other alignment of the axis of rotation.

As in the embodiment of FIG. 1, the helix 1 and the filler material rotate one about the other without performing any rotation of their own, i.e. they retain their orientation. However, in relation to the FIG. 1 embodiment the positions of the filler material and helix 1 are interchanged. Thus it is the filler material that is at the center and extends through the disk 4 and thus along the axis of rotation. The helix in turn, is spaced from the center and passes through an eccentrically disposed aperture. The disk 4 is driven via a V-belt 42' by a drive motor not shown.

In order to avoid a change in mutual orientation of filler material and the helix 1 as a result of contact with the edges of the aperture in the rotating disk 4, the filler material and the helix 1 are passed through the disk 4 by way of the tubes 44 and 2, respectively. These tubes are rotatably supported relative to the disk 4 by way of ball bearings 47.

At its upper end, the tube 44 carries a plate 45 having a gap 46. At the lower end of the tube 44 there is a bobbin holder 48 holding the bobbin 6 which carries the filler material 26. The filler material 26 travels over a yarn guide 55, which simultaneously functions as a yarn brake, and through the tube 44. It then passes through the gap 46 at the upper end of the tube 44 directionally oriented between the windings of the helix 1 into the interior thereof at the point of convergence 60. The bobbin holder 48 thus does not co-rotate with the disk 4.

The tube 2 is supported for rotation relative to the disk 4 by ball bearings in the eccentric aperture in the disk 4. At its upper end, the tube 2 has a slot-shaped opening adapted to the cross sectional configuration of the helix 1, e.g. elliptic for helices with elliptic cross section. The helix 1 is introduced into the lower end of the tube 2 by way of a guide 56 from a stationary supply (not shown). This supply might usually be a container and is not connected to the disk 4. The guide 56 ensures that the helix 1 does not collide with the bobbin holder 48.

Figure 5:
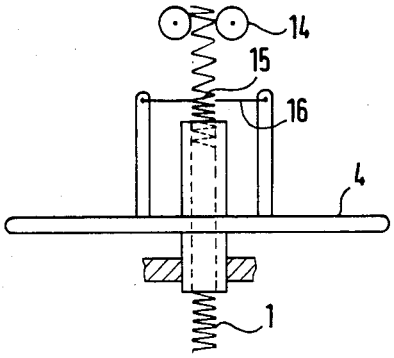

In this embodiment the helix 1 is advanced substantially as illustrated in FIG. 5, namely by way of a pin 15 located in the interior of the helix 1. This pin is held by a fastening wire 16 between two supports 18. The supports 18 hold the pin at a point between the upper end of the tube 2 and the point of convergence 60.

The assembly used to maintain the orientation of the filler material 26 and the helix 1 in FIGS. 17 and 18 is more complicated than the assembly used in embodiment of FIG. 1. Again, a gear 3 is placed on the tube 2 and is connected by a chain or a toothed belt 57 to a gear 5 provided at the central tube 44. The chain or the toothed belt 57 is also triangled around a gear 50 on a shaft 54 which is rotatably supported in the disk 4 at an eccentric point by way of ball bearings 53. The tubes 44 and 2 and the shaft 54 are located approximately at the corners of an equilateral triangle so that there is provided a sufficiently large wrapping angle for the V-belt 57 on the gears 3, 5 and 50.

The shaft 54 extends upwardly beyond the point of convergence 60 and has a further gear 51 at the upper end which is connected with a gear 52 via a chain or a toothed belt. The latter gear 51 is fixedly mounted above the point of convergence and has a central aperture through which the already filled helix 1 is passed upwardly through the nip of draw-off rolls 14. The gears 51 and 52 have equal numbers of teeth and thus the gear 51 and shaft 54 have the same unchanged orientation as the stationary gear 52. The gears 3, 5 and 50 also have the same number of teeth and, owing to the connection with the shaft 54 and the stationary gear 52, likewise have the same orientation.

With the apparatus shown in FIGS. 17 and 18, the helix 1 is virtually laid about the filler material 26. The helix 1 and the filler material 26 therefore retain their orientation, i.e. they do not undergo any longitudinal twisting. Furthermore, as in the FIG. 1 embodiment, the helix 1 rotates about the filler material 26 below the point of convergence.

By means of the yarn guide 55, which also functions as a yarn brake, the filler material 26 is sufficiently tensioned. By virture of the pin 15 held in the interior of the helix by the wires 16 the helix 1 performs a 360° rotation about the pin 15 on each rotation of the disk 4 and is thus advanced by one winding. Since the helix 1 does not perform any substantial rotation about its longitudinal axis, it can be easily fed from a container positioned below the apparatus.

As above mentioned, the draw-off rolls 14 provide the necessary advance of the filled helix 1. Moreover, their speed is so adjusted that the helix 1 is extended somewhat between the pin 15 and the draw-off rolls 14 in order that the filler materail easily slips into the interior of the helix 1.

The advantage offered by the FIGS. 17 and 18 embodiment of the invention over the FIG. 1 embodiment resides in the fact that the rotational inertia is substantially less, since not all the supply of filler material co-rotates at the margin of the disk. In particular, both the bobbin 6 holding the supply of filler material and the container with the helix are standing still. Consequently, the attainable speeds are substantially higher. For this reason, larger bobbins 6 can be used to supply the filler material. the possibility of processing the filler material under higher tension also reduces the risk of undersirable longitudinal twist of the filler material, and thus of faults in the course of operation.

The basic principles underlying the embodiments of the invention shown in FIG. 1 and FIGS. 17 and 18 is, however, substantially the same. Thus, in each case, the helix and the filler material rotate about one another upstream of the point of convergence, while the helix and the filler material retain their orientation. Moreover, the advancing motion of the helix and the speed of rotation at which both rotate are so adapted to one another that the helix is advanced by one winding during each rotation.

It should be noted that in some cases it may be desirable to impart to the filler material a precisely defined low twist. In these cases, only the helix retains its orientation, while the filler material is given a minor twist during each rotation of the disk 4. This may be accomplished by selecting the gear 5 to be somewhat larger or smaller than the gear 3.

In the embodiments of the invention discussed above, the manner of advancing the helix is substantially the same. In this regard, it is surprising that the speed of the draw-off rolls 14 may be somewhat higher than that corresponding to the rate of advance of the helix determined by the speed of rotation of the disk 4. The only effect of this slightly higher speed is to uniformly stretch the helix. Thus, there is no impairments of the coupling between the speed of advance of the helix 1 and the speed of rotation of the disk 4.

If the filler material is to lie straight and without any crimp or other waves in a completed helix belt, the length of the filler material must be controlled in accordance with the length of the helix needed to from the completed belt. This is accomplished by bringing the filled helix 1 into engagement with a further helix 11 of opposite sense of winding, as shown in FIG. 7. The windings of the helix 1 mesh with the windings of the further helix 11 in the same way as in the completed helix belt. The helix 1 thus assumes the same pitch or the same length which it has in the final helix belt and thus draws precisely the required length of filler material off the filler supply. In order to ensure that the filler material is withdrawn from the supply and will not slip back form the already filled portion of the helix 1, the windings of the helices 1 and 11 are forced far enough into one another so that the windings of the further helix 11 clamp the filler material in the helix 1, as also shown in FIG. 7.

The helix 11 may be an auxiliary helix which, after having passed through the pair of rolls shown in FIG. 7, is removed from the helix 1 and circulates on a closed path. In such case, it is necessary that the helix 1 does not contract and thereby crimp the filler material. This can be ensured by requiring that the helix 1 have from the start, the pitch it is required to have in the final helix belt, i.e. generally a pitch of twice the thickness of the wire from which the helix 1 is made.

It is also possible to converge two filled helices 1 of opposite sense of windings. If this is done, the rolls shown in FIG. 7 force the helices one into the other so that in each helix the filler material is clamped. In this case, since both helices 1 are filled, it is not necessary to separate them. More particularly, separation of the helices and the later assembly of the individual filled helices to form the helix belt is disadvantageous because in a single helix the filler material can easily shift and accumulate in some places. When such helices are assembled into a helix belt, this shifting and accumulation of filler may result in non-uniform permeability of the belt, and also may make it difficult or even impossible to properly mesh the helices. On the other hand, if the helices 1 are meshed in pairs when the filler material is introduced, each helix prevents shifting of the filler material in the respective other helix. A further advantage of meshing helices at the time of filling resides in the fact that the filler material is clamped not only at one place, but also along the entire zone of the already meshed portion of the two helices, thereby forming a clamping zone which ensures a precisely adapted length of the filler material.

When the filler material is introduced into two helices 1 and these helices are thereafter meshed with one another to clamp the filler material in place, it is advantageous to wrap the helices 1 with a wrapping yarn 24 to prevent them from unintentionally separating again. An assembly for carrying out this wrapping process is shown in FIG. 8.

A bobbin 20 upon which is wound yarn 24 and a yarn guide support 21 are mounted for rotation about a stationary tube 19. The two meshed filled helices 1 travel through the tube 19. The wrapping yarn 24 runs from the bobbin 20 which is situated below the yarn guide support 21, through the yarn guides 22 and 23 fixedly mounted to the yarn guide support 21 and to the two helices 1 at a point above the upper end of the stationary tube 19. Only the bobbin 20 is driven, in winding direction as shown in FIG. 9. The yarn guide support 21 is carried along by the wrapping yarn 24 running through the yarn guides 22 and 23, i.e. it is caused to rotate. As it does so, it wraps the wrapping yarn 24 about the two helices 1 upon the helices leaving the upper end of the stationary tube 19. The wrapping yarn 24 passes about the filler material 26 in the helices 1 thereby preventing the helices 1 from separating.

The wrapping yarn 24 is to be supplied without tension and with a certain overfeed, as shown in FIGS. 10 and 10*a*, otherwise the filler material 26 in each helix would be drawn together thus preventing the formation of a passageway 28 for insertion of a pintle wire. FIG. 10*b* shows how a wrapping yarn 24 fed with too little overfeed prevents the formation of the passageway 28 for the pintle wire.

The freedom of tension and the overfeed of the wrapping yarn 24 is realized in the FIG. 10 apparatus utilizing one or more stiff wires 29 mounted on the stationary tube 19, e.g. by way of an annular flange 27. These wires extend in the direction of advance of the helix 1 and, at the point of their attachment to flange 27, are spaced relatively widely from the longitudinal axis of the tube 19. They then substantially "asymptotically" approach the longitudinal axis so that at their upper ends they are spaced apart the distance required for the desired overfeed of the wrapping yarn 24. The rigid wires 29 may also extend straight and paralled to the longitudinal axis at the distance required for the overfeed of the wrapping yarn 24.

The wrapping yarn 24 is supplied directly above the upper end of the staionary tube 19 and is first passed around the helices 1 and the rigid wires 29 (FIGS. 11*a*, *b* and *c*). The helices are advanced by a draw-off means 30 thereby entraining the wrapping yarn 24. Since an overfeed of the wrapping yarn 24 now takes place, the helices 1 can be finally meshed with one another by the draw-off means 30, and any possible protruding loops of the wrapping yarn 24 slip into the interior of the helices. In case the wires 29 asymptotically approach each other, the overfeed of the wrapping wire 24 can be increased by so adjusting the yarn guide 23 that it feeds the yarn at a point where the two wires 29 are spaced farther apart, i.e. at a point that is at a lower level.

In general, even without the draw-off means 30, the protruding loops of the wrapping yarn 24 will slip into the interior of the helices, since they are spontaneously drawn in by the elasticity of the filling.

As shown in FIG. 11*a* and 11*d*, a suitable draw-off means includes four rolls. The surfaces of the rolls are shaped so that they form a frame or compartment around the two helices 1. In the presently described embodiments and as illustrated, the helices have an oval cross section. This type of cross section is generally customary for helix belts, especially when contemplated for use as papermachine screens. The two opposite rolls engaging the long sides of the helixes therefore have cylindrical surfaces, while the two opposite rolls engaging the short sides of the helices 1 have concave surfaces and resemble rope pulleys.

The helices 1 held to one another by means of the wrapping yarn 24 can be further processed into a completed helix belt. As above mentioned, the wrapping yarn 24 prevents the filling from spreading over the entire cross section to the helix interiors. This leaves a space into which a further helix can be inserted when forming the completed belt. A significant advantage thereby results since without the yarn considerable difficulties are invariably encountered in meshing filled helices with one another.

The wrapping yarn 24 may be made of a material that can be removed in a simple way at a later date. Thin polypropylene or polyethylene yarns are especially suited, since the low melting point of these materials causes the materials to melt when the helix belt is being set. Water-soluable yarns, e.g. yarns made from Solvron, can also be used. In such case, the final helix belt need only be subjected to a treatment with hot water to dissolve the wrapping yarn.

The apparatus of the invention shown in FIG. 1 may also be modified so the helix is would about the filler material, rather than the filler being introduced into the helix. To realize this, the bobins 6 and 7 are replaced by a container containing the helix and the filler material is supplied through the tube 2. In this situation, the angle alpha of introduction between the helix and the filling must be made very small.

In usual practice, two of the assemblies shown in FIG. 1 are provided for introducing the filler material. The resultant filled helices are then converged as shown in FIG. 7 and thereafter wrapped as shown in FIGS. 8 and 11*a*.

Since no torsion is imparted to the filler material, it may be in the form of a tape yarn or film strip which extends flat in the helix. An especially advantageous filler material comprises woven or braided tubing 31. When a tube 31 is utilized as filler material, it tends to assume its normal round cross section and therefore readily clings to the inside of the helix 1, as shown in FIG. 12. With this type of filler, it is necessary that the external circumfernce of the tube 31 be made equal to the internal circumference of the helix 1. Tubing 31 is advantageous as filler material because, it completely fills the interior of the helices 1 and it offers little resistance when the helices 1 are meshed with one another. FIG. 13 shows how the tubing 31 deforms as the helices 1 are meshed.

A further advantage resides in the fact that tubing 31 reduces the air permeability of a helix belt beyond that obtainable with yarn, monofilaments or tape. FIG. 14 illustrates this difference. In the upper drawing of FIG. 14, the section A and B are filled with round and flat filler material, respectively. The unfilled zone Z is relatively large since only the portion between the winding arcs of the preceding helix and the following helix can be filled. In the lower drawing of FIG. 14, the regions C are filled with tubular filler material. The unfilled zone Z, in this case, is substantially smaller since the tubes 31 partially extend around the winding arcs of the adjacent helices. In this way a lower permeability helix belt is achieved.

Since the filler material is introduced into the helices prior to the assembly and prior to the final thermosetting step, care must be taken that the tubes 31 do not shrink during setting of the belt. This is accomplished by pre-shrinking the tubes at a temperature of about 20° C. above the belt thermosetting temperature, prior to introducing the tubes into the helices.

When tubes 31 are used as filler material the weight of the filler material and thus the total weight of the helix belt is reduced. When very light thin-walled tubes 31 are employed it may be advisable to provide the tubes with a core 32, e.g. of textile yarn, in order to prevent the tubes 31 from collapsing. Preferably the core has a lower shrinkage than the tube material. As a result, during pre-shrinkage (thermosetting of the tubes 31 prior to introduction thereof into the helix 1) the tube 31 shrinks more than the core 32 and the core 32 undulates in the tube 31, as demonstrated in FIG. 16.

In FIG. 15, the tube 31 with the core 32 is shown prior to thermosetting. The undulated, crimped and deformed core 32 exerts an outwardly directed pressure against the inside of the tube 31. The tube 31 will thus not collapse even after insertion into the helix 1 and after assembly of the helix belt. Furthermore, it fills the interior of the helices 1 as far as possible and clings to the winding arcs of the adjacent helices 1, respectively.

For further reduction of the unfilled zone Z in FIG. 14, the helices 1 may be manufactured from a synthetic resin monofilament of flat cross section so that the apparent diameter of the synthetic resin monofilament of the helices 1 is smaller when viewed in the direction of the helix axis. From the foregoing statements it will be apparent that the braided tube is in general, especially suited as filler material, no matter whether the filler material is introduced already in the manufacture of the helices or later into the helix belt assembly.

In general, the helices 1 are wound from a synthetic resin monofilament. In case the helices are to be used to form a belt as a covering in a papermaking machine, the helices generally are made from polyester monofilament.

As will also be appreciated from the above, the helix structure 1 made in accordance with the invention can be of great length, i.e. the helix may be along as desired. In the production of a helix belt by meshing helices according to conventional methods, helices having any desired length prior to meshing and are cut to a size corresponding to the helix belt only after meshing. Therefore, prior to meshing, the helices may have a length, for example, of the order of 300 meters. This requires, in the case of filled helices, that the helices be filled along this long length. However, prior to the present invention filled helices of such long length could not be produced, not even manually. The present invention thus permits the realization of uniformly filled helices having a great length (i.e. of the order of 300 meters) while avoiding any torsion of the filler material.

Furthermore, since in the present invention, the filler material is introduced continuously into the helices and has no or a defined uniform degree of torsion the interior of the helices, if filled uniformly along the helix axis up to a certain percentage, and the helix belts therefrom have uniform permeability. The uniform permeability is also retained when filler material in the form of a plurality of monofilaments is introduced into each helix since these can be introduced in parallel.

In all cases, it is understood that the above-described arrangements are merely illustrative of the many possible specific embodiments which represent applications of the present invention. Numerous and varied other arrangements can be readily devised without departing from the spirit and scope of the invention.

What is claimed is:

1. A method for introducing filler material into a helix structure for producing a filled helix of great length, the method comprising:

advancing the helix in a direction along the longitudinal axis of said helix;

introducing filler material into the helix between the windings of the helix at the point at which the helix and filler material converge;

orbiting the helix and the filler material about one another at a position preceding the point at which the helix and filler material converge, while the helix is kept from rotating about its longitudinal axis; and adjusting the advancing motion of the helix and the speed at which the filler material and the helix orbit about one another so that the helix is advanced by one winding of the helix during each orbit of the filler material and the helix about one another.

2. A method in accordance with claim 1 wherein:

introducing said filler material includes feeding said filler material from a supply of filler material orbiting about the helix while the supply of filler material is kept from rotating about its longitudinal axis during each orbit of the filler material about the helix.

3. A method in accordance with claim 1 wherein:

said step of introducing said filler material includes advancing said filler material to the point at which said filler material converges with said helix.

4. A method in accordance with claim 1 further comprising:

after introducing the filler material, meshing the filled helix with a further helix to such an extent that said further helix clamps the filler material.

5. A method in accordance with claim 4 wherein:

said further helix contains filler material; and said method further comprises wrapping yarn about the two helices.

6. A method in accordance with claim 1 wherein:

introducing said filler material includes feeding said filler material from a supply of filler material orbiting about the helix while the supply of filler material is rotated about its longitudinal axis by a predetermined amount during each orbit of the filler material about the helix.

* * * * *